US006333719B1

(12) United States Patent
Varadan et al.

(10) Patent No.: US 6,333,719 B1
(45) Date of Patent: Dec. 25, 2001

(54) TUNABLE ELECTROMAGNETIC COUPLED ANTENNA

(75) Inventors: Vijay K. Varadan, State College, PA (US); Peng Thian Teo, Singapore (SG)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 09/595,987

(22) Filed: Jun. 16, 2000

Related U.S. Application Data

(60) Provisional application No. 60/139,712, filed on Jun. 17, 1999.

(51) Int. Cl.[7] ..... H01Q 1/00

(52) U.S. Cl. ..... 343/787; 343/700 MS; 343/909; 333/161

(58) Field of Search ..... 343/787, 778, 343/700 MS, 753, 754, 909, 911; 333/33, 161; 501/137; H01Q 1/00, 1/38

(56) References Cited

U.S. PATENT DOCUMENTS

| | | | |
|---|---|---|---|
| 5,307,033 | 4/1994 | Koscica et al. | 333/161 |
| 5,427,988 | 6/1995 | Sengupta et al. | 501/137 |
| 5,557,286 | 9/1996 | Varadan et al. | 343/700 |
| 5,561,407 | 10/1996 | Koscica et al. | 333/161 |
| 5,589,845 | 12/1996 | Yandrofski et al. | 343/909 |
| 5,617,104 | 4/1997 | Das | 343/700 |
| 5,729,239 | 3/1998 | Rao | 343/753 |
| 6,049,726 * | 4/2000 | Gruenwald et al. | 505/210 |
| 6,160,524 * | 12/2000 | Wilber | 343/787 |

OTHER PUBLICATIONS

"Ceramic Phase Shifters for Electronically Steerable Antenna Systems" by Varadan et al., 1992, pps. 5 pages, Microwave Journal, pp. 116–126.

"Ferroelectric Materials for Phased Array Applications", IEEE Antennas & Propogation Society International Symposium, vol. 4, pp. 2284–2287, 1997.

* cited by examiner

*Primary Examiner*—T. Phan

(74) *Attorney, Agent, or Firm*—Ohlandt, Greeley, Ruggiero & Perle, L.L.P.

(57) ABSTRACT

A multilayer tunable ferroelectric antenna assembly which includes a first laminar structure that includes a tunable ferroelectric substrate positioned on top of a conducting ground plane and a copper radiating sheet on the other side of the substrate. A second laminar structure includes a single-sided copper cladded high dielectric substrate with the copper sheet acting as the radiator. The passive second laminar structure is electromagnetically coupled to the first laminar structure via an air-gap spacing. Application of a bias voltage across the first laminar structure changes the dielectric permittivity and, hence, the resonating frequency of the antenna structure.

18 Claims, 3 Drawing Sheets

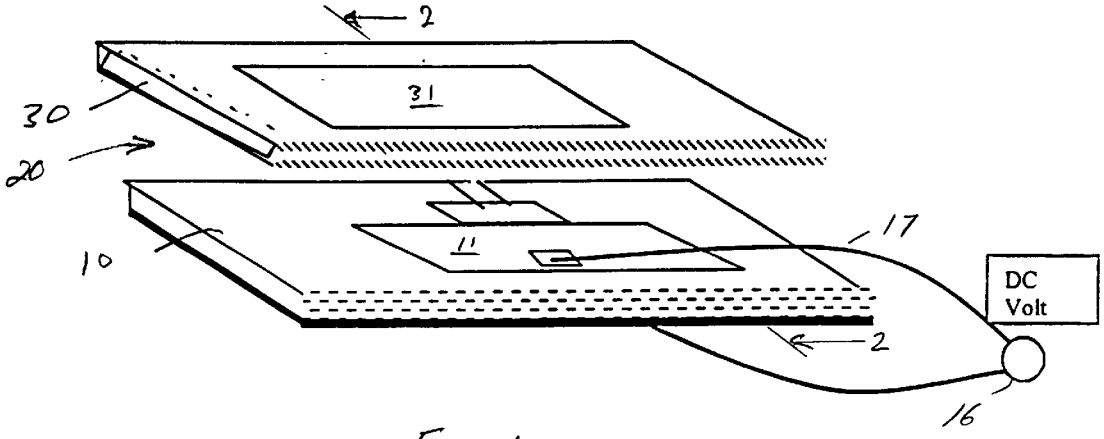
FIG. 1
FIG. 2
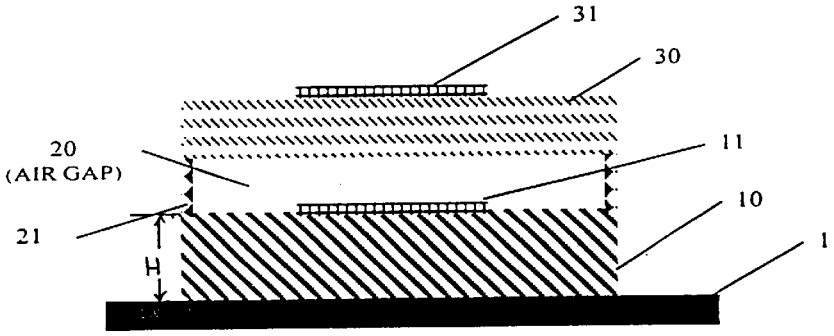
FIG. 3
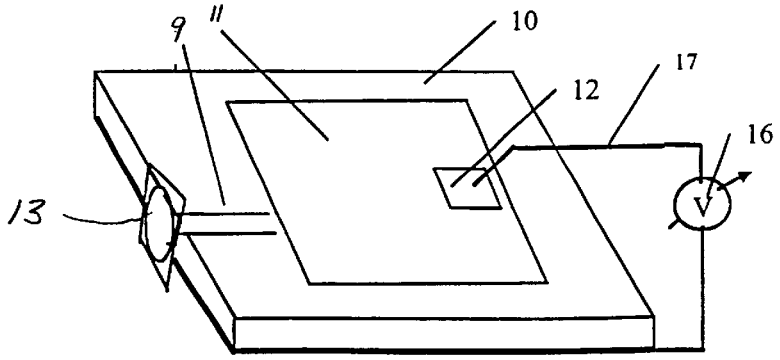

TUNABLE ELECTROMAGNETIC COUPLED ANTENNA

This application claims the benefit of U.S. Provisional Application No. 60/139,712, filed Jun. 17, 1999.

FIELD OF THE INVENTION

This invention relates to microwave antenna and, in particular, is directed to a tunable ferroelectric stacked antenna with enhanced bandwidth and gain.

BACKGROUND OF THE INVENTION

Tunable antennas with different operating frequency bands have received increasing attention recently. However, most of them use diodes or shorting pins to achieve tuning performance. This additional circuitry adds protrusion and complexity to the circuit structure that impedes the capability of these antennas to operate in a high temperature, conformal and rugged environment.

The use of ferroelectric materials in phase shifters is disclosed in "Ceramic Phase Shifters for Electronically Steerable Antenna Systems", Varadan et al., Microwave Journal, January 1992, pages 116–126. Some different configurations also appear in U.S. Pat. No. 5,561,407 and U.S. Pat. No. 5,307,033, both issued to Koscica et. al. The use of ferroelectric tunable resonators in filter circuits appears in U.S. Pat. No. 5,617,104 to Das. Ferroelectric materials have also been described for use in electronic phased scanning periodic arrays. For example, such arrays are described in U.S. Pat. No. 5,589,845 to Yandrofski et al., U.S. Pat. No. 5,729,239 to Rao and U.S. Pat. No. 5,557,286 to Varadan et. al. In such arrays, electrical scanning of an RF energy beam pattern is the main concern.

The common dielectric constant values for barium strontium titanate materials used in the systems disclosed in U.S. Pat. No. 5,427,988 to Sengupta et al. and U.S. Pat. No. 5,557,286 to Varadan et al. are relatively high for typical antenna applications. The challenges and difficulties to produce a low dielectric constant material with good electrical properties for antenna applications has been highlighted in "Ferroelectric Materials For Phased Array Applications", Rao et. al., "IEEE Antennas & Propagation Society International Symposium", volume. 4, pages. 2284–2287, 1997. In trying to produce a low dielectric substrate, electrical inhomogeneity, low tunability and poor loss tangent performance are the commonly associated drawbacks. As a result, most of these ferroelectric antennas are realized on a high dielectric constant substrate.

Microstrip antennas with high permittivity substrates suffer from poor efficiency due to the energy loss associated with the excitation of surface wave modes. It has been found that for a single layer ferroelectric antenna with dielectric constant of around 16, the radiating output power from the antenna is lower than the power supplied to the input port. Parasitically coupled antennas may be used to increase the gain, but for these antennas, the performance is optimized at a certain discrete frequency only.

Accordingly, there is a need for a compact antenna that is electrically tunable. There is also a need for such an antenna with a substantial bandwidth and gain.

SUMMARY OF THE INVENTION

The present invention provides an antenna structure, which operates in a continuous tunable mode, which exhibits resonance at different tunable frequency bands and at the same time has a substantial bandwidth and enhanced radiation efficiency.

The antenna of the invention has a stacked assembly that includes a ferroelectric substrate that carries on one face thereof an electrically ground plane and on its opposite face an electrically conductive patch serving as an active feeder-resonator. A second dielectric layer is supported above the ferroelectric substrate. A parasitic radiator patch is disposed on top of the second dielectric layer. The resonant frequency of the stacked antenna assembly varies with the value of a DC voltage applied across the ferroelectric substrate. The tunable ferroelectric substrate has the advantage of being conformal and yet achieving the goal of a frequency hopping microwave communication system.

An aspect of the invention is an air gap between the ferroelectric substrate and the second dielectric layer. The air gap space provides two important useful features for the antenna structure. First, it enhances the gain of the antenna structure. Second, it allows wire connections to the feeder resonator for the coupling of the bias voltage thereto. The air gap also serves to enhance an electromagnetic coupling of electrical energy from the feeder resonator to the parasitic radiator.

In accordance with another aspect of the invention, a DC bias pad is positioned along the centerline of the feeder resonator. The centerline lies on the symmetry plane that bisects the feeder resonator patch into two equal halves. DC voltage is then applied via a DC block to the bias pad.

Another aspect of the invention is a cascaded of multi-stage feed network is designed and optimized on the ferroelectric tunable substrate. The tunable feed network provides a frequency variable impedance matching function for the antenna structure over different frequency bands.

BRIEF DESCRIPTION OF THE DRAWING

The objects, advantages and features of the present invention will be understood by reference to the following specification in conjunction with the accompanying drawings, in which like reference characters denote like elements of structure and:

FIG. 1 is a perspective view of the antenna of the present invention.

FIG. 2 is a cross-sectional view taken along line 2—2 of FIG. 1.

FIG. 3 is a perspective view of the first ferroelectric laminar with the feeder-resonator deposited on it.

DETAILED DESCRIPTION OF THE INVENTION

Figure 4:
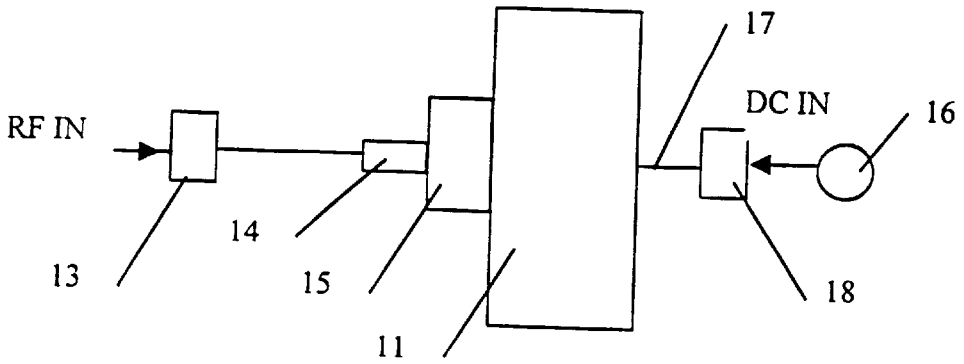
FIG. 4 is a schematic diagram that includes the tunable matching ferroelectric substrate and some external biasing circuits.

Referring to FIGS. 1 and 2, the tunable antenna of the present invention includes a first substrate layer 10 that is spaced apart from an overlying second dielectric layer 30 via an air gap 20. First substrate layer 10 is disposed on a ground plane 1. A feeder-resonator 11 is located in air gap 20 and is disposed on the top of first substrate layer 10. An electrically conductive sheet 31 is disposed on the top of second dielectric layer 30. Conductive sheet 31 and second dielectric layer 30 together form a parasitic radiator that derives its energy via electromagnetic coupling from feeder-resonator 11.

First substrate layer 10 is formed of a ferroelectric material, such as barium strontium titanate or any other low loss perovskite and paraelectric films. Second substrate layer 30 has a low loss and low dielectric material available, for example, under the Duroid™ brand from Rogers Corporation of Chandler, Ariz. First substrate layer 10, ground plane 1 and feeder-resonator 11 form a stacked assembly and are adhered to one another by any suitable technique, such as adhesive bonding or microwave joining. Similarly, second dielectric layer 30 and conductive sheet 31 are joined together by similar techniques.

Ferroelectric substrate 10 has a thickness H that separates feeder-resonator element 11 from highly conductive ground plane 1. The permittivity of second substrate layer 30 is designed to be higher than that of layer 10. In a preferred embodiment, feeding resonator element 11 is designed with a length approximately equal to a quarter wavelength ($\lambda/14$) of a desired center frequency at which resonance will occur. This resonance phenomenon is characterized by a minimized reflection at an input port 13, shown in FIG. 3. The S11 value used in the design is about −24 dB, while a VSWR figure of less than about 2 is also used as a guideline.

Referring to FIGS. 1 and 3, a variable voltage source 16 is connected to apply a bias voltage between feeder resonator 11 and ground plane 1, thereby changing the dielectric constant and the resonating frequency of the entire antenna device. Tunability may then be defined to be the derivative of the new resonating frequency and the designed center frequency, with the antenna performance being constant or kept to a slight variation. A feed 9 feeds received RF energy from RF input port 13 to feeder resonator 11.

Referring to FIG. 3, a DC bias pad 12 is positioned along a centerline of feeder-resonator 11. The centerline lies on the same orientation as the input feed and bisects feeder-resonator 11 into two equal halves. This location is chosen so as to minimize interference caused by the excitations of other higher wave modes. In addition, bias pad 12 is positioned near the edge opposite the input feed to ensure that DC feed line 17 does not impede the antenna performance.

Referring to FIG. 4, a DC capacitor block 13 prevents high DC voltage from destroying the RF signal sources. A resistance and inductor element 18 prevents the RF signal from leaking into DC source 16.

Due to the high dielectric constant of the ferroelectric material, the microstrip line feed 9 on ferroelectric substrate 10 has an impedance typically less than about 10 ohms. The impedance of the antenna is a function of the substrate properties. Hence, when the applied bias voltage varies, the dielectric constant changes and the input impedance of the antenna changes. Impedance mismatch arises between the fixed feeding structure of a pair of signal feed elements 14 and 15 (FIG. 4) and the varying input impedance.

Figure 5:
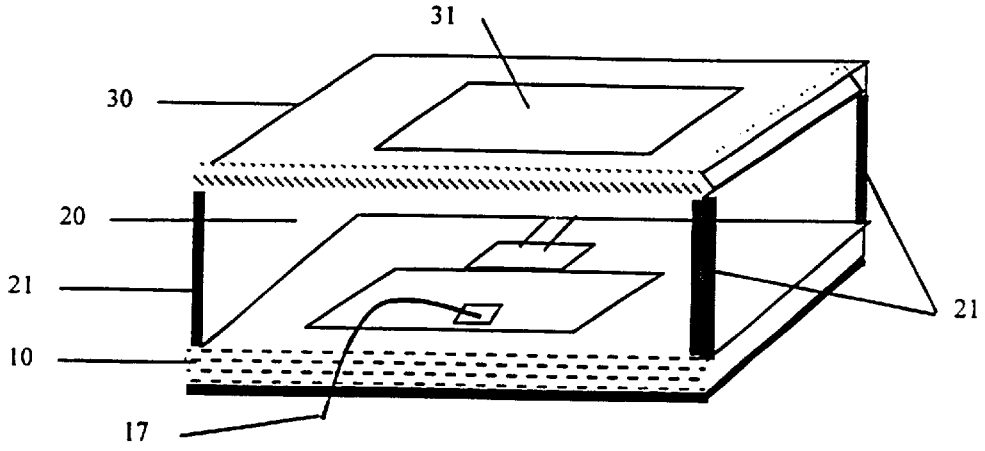
FIG. 5 is another perspective view of the layered antenna structure.

Referring to FIG. 4, another aspect of the invention incorporates signal feed elements 14 and 15 as a cascaded feed network fabricated on the same tunable ferroelectric substrate 10. This network is formed on the same layer of metal that is used for feeder-resonator element 11 to assure electrical continuity. Hence, feed elements 14 and 15 and feeder-resonator 11 experience a similar tunability response. This minimizes abrupt changes in impedance as compared to that with a fixed antenna feed and a tunable antenna. Arranging feed elements 14 and 15 in a cascading manner is aimed to improve the narrow bandwidth of the high dielectric antenna. Another feature of the invention is that planar microstrip feed 9 is used instead of a probe feed method. This avoids a need to drill a hole through the ceramic ferroelectric layer 10, which might crack, due to its brittleness, and distort the uniformity of substrate layer Referring to FIG. 5, supports 21, such as insulating standoffs (e.g., Nylon) or plastic foams, separate ferroelectric layer 10 and second dielectric layer 30. Supports 21 are positioned in a manner that minimizes interference with the antenna performance. Air gap 20 provides room for connection of DC feed line 17 and enhances the gain of feeder-resonator 11. The thickness of air gap 20 may be varied to optimize gain, resonating frequency and impedance matching of the layered antenna structure. However, it is found that optimization of the antenna performance requires simultaneous variation of the thickness of air gap 20 and the dielectric constant and the thickness of second dielectric layer 30. This is done after an optimized design has been achieved for feeder-resonator 11 on ferroelectric substrate 10. The air gap separation distance is kept around 4 times the thickness of ferroelectric layer 10.

A positive value of realized gain may be obtained with the second layer 30 having a thickness similar to that of ferroelectric layer 10 and a dielectric constant at least 6.25 times that of ferroelectric layer 10. Parasitic radiating element 31 is maintained at a similar dimension as that of feeder-resonator 11. This gain performance is very attractive when compared to a negative gain value obtained with a single layer structure that consists of ground plane 1, ferroelectric layer 10 and feeder-resonator 11. The power output is smaller than the input power for such single layer structure high dielectric antenna. Realized gain G (in dB) is defined as:

$$G(dB)=20 \log (\text{power out}/\text{power input}).$$

Figure 6:
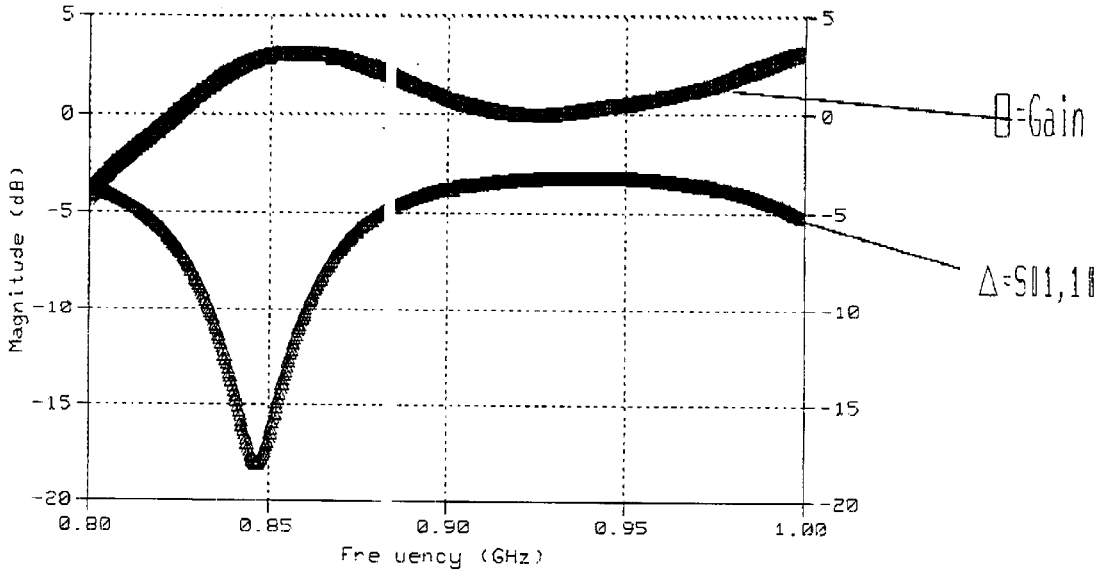
FIG. 6 is a graph depicting the enhanced gain and S11 input reflection layered structure of the invention.
Figure 7:
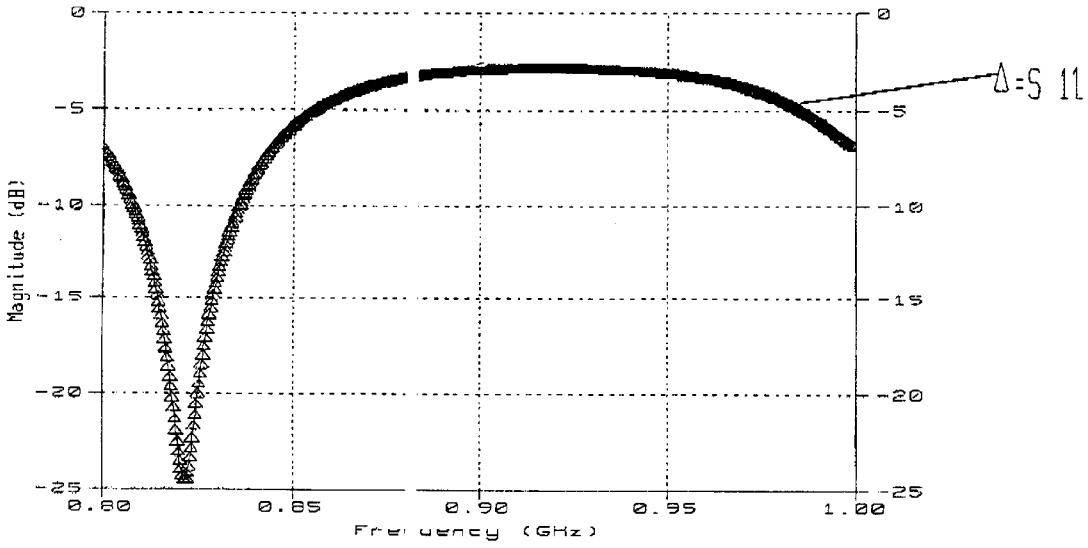
FIG. 7 is a graph showing the optimized S11 performance being tuned to a different frequency band.

Referring to FIG. 6, the improved gain performance achieved with the multi-layer structure is depicted. By varying the dielectric constant of ferroelectric layer 10, it can be shown that the optimized S11 and VSWR performance for the multi-layered antenna structure is repeated at other resonating frequencies, thereby demonstrating the effect of tunability. The gain performance, however, might degrade earlier when the dielectric constant is varied over a wider range.

By way of example, a single layer antenna is first constructed with a ferroelectric layer and a feeder-resonator. The ferroelectric layer has a dielectric constant of 16, a loss tangent of 2.82 and a thickness of 1.5 mm. The feeder-resonator has a dimension of 48 mm by 41.34 mm. The S11 has an optimized value of −44 dB at a frequency of 915 MHz. The gain is −10 dB. The tunability obtained is 2.8% with a bias voltage of 1.46 kV.

On the other hand, the multi-layer antenna of the invention, for this example, has an air gap separation of about 7 mm. Second dielectric layer 30 has a dielectric constant of 120 and a thickness of 1.6 mm. The dimension of conductive sheet 31 is reduced slightly compared to that of feeder-resonator 11. The gain obtained is 3.8 dB at 848 MHz. Optimized performance is repeated over at least a 3% tunable shift in frequency. The shift in center frequency is due to second dielectric layer 30. However, a positive gain is achieved where there is in no way possible for a single layer structure, even though the S11 and VSWR performance are optimized.

The entire antenna structure can operate in a continuous tunable mode that exhibits resonance at different tunable frequency bands and at the same time with enhanced radiation efficiency. Applications may include, but are not limited to, frequency hopping communications systems, adaptive antenna arrays and antennas for re-entry vehicles.

The present invention having been thus described with particular reference to the preferred forms thereof, it will be obvious that various changes and modifications may be made therein without departing from the spirit and scope of the present invention as defined in the appended claims.

What is claimed is:

1. A tunable antenna comprising:

a stacked assembly including:

a feeder-resonator disposed on a layer of ferroelectric material;

a radiator that includes an electrically conductive layer disposed on a layer of dielectric material and that is disposed above said feeder resonator;

a support structure that supports said radiator above said layer of ferroelectric material with an air gap therebetween; and wherein said feeder-resonator is located within said air gap, wherein electromagnetic energy is coupled from said feeder-resonator via said air gap to said radiator, wherein said stacked assembly exhibits a resonant frequency that is tunable in response to a bias voltage applied to said ferroelectric layer, and wherein said layer of dielectric material has a higher permittivity than that of said layer of ferroelectric material.

2. The tunable antenna of claim 1, wherein said air gap defines a separation distance from said feeder-resonator to a bottom surface of said dielectric layer that is at least 4 times the thickness of said layer of ferroelectric material.

3. The tunable antenna of claim 1, wherein said electrically conductive layer has a dimension equal to or smaller than that of said feeder-resonator.

4. The tunable antenna of claim 1, wherein a DC bias pad is positioned substantially at a centerline of said feeder-resonator to avoid excitation of higher wave modes, wherein said DC pad allows said bias voltage to be applied across said layer of ferroelectric material, thereby changing the dielectric properties of said ferroelectric material and thereby changing the resonance frequency of said stacked assembly.

5. The tunable antenna of claim 4, wherein an input signal feed line for said feeder-resonator is disposed on said layer of ferroelectric material, and wherein said feed line is offset from said centerline.

6. The tunable antenna of claim 1, wherein said ferroelectric material includes barium strontium titanate.

7. The tunable antenna of claim 1, further comprising an electrically conductive ground plane disposed beneath said layer of ferroelectric material.

8. The tunable antenna of claim 7, further comprising means for applying said bias voltage between said feeder-resonator and said ground plane.

9. The tunable antenna of claim 1, wherein a tunable feed network for said feeder-resonator is disposed on said layer of ferroelectric material.

10. The tunable antenna of claim 9, wherein said tunable feed network includes a quarter wavelength transformer, and wherein said tunable feed network provides a tunable impedance matching to said feeder-resonator.

11. The tunable antenna of claim 10, wherein said air gap defines a separation distance from said feeder-resonator to a bottom surface of said dielectric layer that is at least 4 times the thickness of said layer of ferroelectric material.

12. The tunable antenna of claim 9, wherein said electrically conductive layer has a dimension equal to or smaller than that of said feeder-resonator.

13. The tunable antenna of claim 9, wherein a DC bias pad is positioned substantially at a centerline of said feeder-resonator to avoid excitation of higher wave modes, wherein said DC pad allows said bias voltage to be applied across said feeder-resonator, thereby changing the dielectric properties of said layer of ferroelectric material and thereby changing the resonance frequency of said stacked assembly.

14. The tunable antenna of claim 9, wherein said ferroelectric material includes barium strontium titanate.

15. A tunable antenna that exhibits enhanced gain over a wide frequency band comprising:

a ferroelectric substrate with a feeder resonator disposed thereon; and a radiator disposed above said ferroelectric substrate and separated therefrom by an air gap, wherein said air gap is about four times a thickness of said ferroelectric substrate such that an enhanced gain is produced substantially over said wide frequency band.

16. The tunable antenna of claim 15, wherein a tunable feed network for said feeder-resonator is disposed on said ferroelectric substrate, and wherein said tunable feed network provides a tunable impedance matching to said feeder-resonator.

17. A tunable antenna that exhibits enhanced gain over a wide frequency band comprising:

a ferroelectric substrate with a feeder resonator disposed thereon; and a radiator that includes an electrical conductor disposed on a layer of dielectric material is disposed above said ferroelectric substrate and separated therefrom by an air gap, wherein said dielectric material has a dielectric constant that is at least about 6.25 times that of said ferroelectric substrate such that an enhanced gain is produced substantially over said wide frequency band.

18. The tunable antenna of claim 17, wherein said air gap is about four times a thickness of said ferroelectric substrate.

* * * * *